United States Patent [19]

Garside

[11] 4,041,725

[45] Aug. 16, 1977

[54] CONTROL SYSTEM FOR REFRIGERATION UNIT

[75] Inventor: David Garside, Rosemere, Canada

[73] Assignee: Galt Equipment Limited, Candiac, Canada

[21] Appl. No.: 664,026

[22] Filed: Mar. 4, 1976

[51] Int. Cl.[2] ..... F25D 25/00

[52] U.S. Cl. ..... 62/223; 62/231; 62/514 R; 236/80 R

[58] Field of Search ..... 62/514, 231, 223; 236/80 R, 46 R

[56] References Cited

U.S. PATENT DOCUMENTS

| | | | |
|---|---|---|---|
| 3,415,077 | 10/1968 | Collins | 62/514 |
| 3,708,995 | 1/1973 | Berg | 62/514 |
| 3,802,212 | 4/1974 | Martin et al. | 62/514 R |
| 3,823,575 | 7/1974 | Parel | 62/514 R |
| 3,845,636 | 11/1974 | Van Mal et al. | 62/514 R |
| 3,866,430 | 2/1975 | Webber | 62/514 R |

FOREIGN PATENT DOCUMENTS

| | | | |
|---|---|---|---|
| 1,501,207 | 8/1969 | Germany | 62/514 |

*Primary Examiner*—William E. Wayner
*Assistant Examiner*—Robert J. Charvat
*Attorney, Agent, or Firm*—Larson, Taylor and Hinds

[57] ABSTRACT

A control system for a refrigeration unit incorporating a pressurized liquid gas reservoir is disclosed. The control system is self-contained and suitable for use in the transportation of food in containers. The improvement of the present system is that it avoids overshoot problems in feeding liquid gas coolant to the container. The system includes a gas line from a liquified gas reservoir, a first gas pressure actuated three-way valve, a second gas pressure three-way valve, a first restricting means which provides a time delay for switching the second three-way valve from being connected to the gas line to vent and a second restricting means which provides a second time delay for switching the second three-way valve from vent to the gas line. A temperature sensing control is also incorporated in another embodiment of the invention.

11 Claims, 5 Drawing Figures

CONTROL SYSTEM FOR REFRIGERATION UNIT

This invention relates to a control system for a pressurized liquid gas reservoir incorporated in a refrigeration system. More particularly, the invention provides a control system which is self-contained and utilizes a gas from a pressurized liquified gas reservoir for controlling the flow of the liquified gas to an area to be refrigerated.

There is a need today to provide a simple selfcontained refrigeration unit for cooling storage areas and cargo containers used in the transportation of food from place to place. By the term "container" is meant any enclosed cargo-carrying unit suitable for the shipment of goods to be kept refrigerated, such as food, and includes standard or non-standard containers, truck bodies, rail cars, and the like. An example of such a system for cooling containers is disclosed in John K. Foessl's co-pending U.S. application Ser. No. 624,445, filed Oct. 21, 1975.

The use of gas as a control media in refrigeration systems incorporating liquified gas coolants is well known. The most common types of gases used as liquified gas coolants are liquid nitrogen and liquid carbon dioxide. Whichever type of gas coolant is used, most systems have a temperature sensing device within the refrigeration chamber which through a controller activates a valve to control the flow of liquified gas through a nozzle or aperture into the chamber. One problem that exists with these systems is the response time of the temperature sensing devices. In most cases, these devices take from 20 to 30 seconds to signal a change in temperature, and thus, in nearly every case, there is an overshoot of liquified gas into the chamber. In the case of liquid nitrogen, the liquid boils off and passes out through a vent. Thus the cooling media is wasted, and the duration of cooling from the coolant reservoir is reduced. In the case of liquid carbon dioxide, there is generally a longer time delay for the temperature in the chamber to drop as some of the $CO_2$ forms into a solid which slowly sublimates to carbon dioxide gas. Thus the temperature in the chamber continues dropping after the injection of liquid carbon dioxide, until all the solid carbon dioxide has completely sublimated. Attempts have also been made to reduce the size of the nozzle or aperture through which the liquified gas enters the refrigeration chamber. However, in the case of liquid carbon dioxide, small openings tend to clog up as solid carbon dioxide forms around the nozzle. Furthermore, small openings do not permit the liquified gas to be projected for the full length of the chamber and thus uneven cooling occurs in the chamber.

The present invention provides a control system which utilizes the gas above the liquified gas in the coolant reservoir. The control system operates a flow valve in a liquified gas line to the cooling chamber and allows liquified gas to flow for a short period of time at predetermined time intervals. Thus a fairly high flow occurs for a short period of time which avoids the overshoot problem. The time interval between gas flow periods allows the temperature sensing device to respond without an overshoot occurring. Such a system may be utilized without a temperature sensing device to monitor the flow of the coolant. The cooling requirememt of a chamber may be calculated, and the quantity of coolant required over a period of time determined. The time of the coolant flow periods and the time intervals between may be set and the capacity of the coolant reservoir determined.

In situations where the outside temperature surrounding the chamber has considerable variation, then a temperature sensing device may be located inside or outside the chamber to initiate the flow of coolant for short periods of time at predetermined time intervals. The time of coolant flow is such that overshooting does not occur, and the intervals between flows overcome the slow reaction time of the sensing device. The time of coolant flow and time interval between coolant flows is set, and the temperature sensing device merely initiates and terminates the cycle.

By the term "three-way valve" is meant a two position valve which switches the flow from a common valve port through a normally open valve port to the common valve port through a normally closed valve port. Such a valve may be manually operated, or gas pressure actuated either by a diaphragm or a piston. It has been found that whereas a diaphragm operated valve is satisfactory for gas control and liquid nitrogen flow, a piston operated valve is preferred for liquid carbon dioxide flow.

The present invention provides in a refrigeration unit including a pressurized liquified gas reservoir and a gas pressure actuated flow valve for releasing the liquified gas, the improvement of a control system for metering liquified gas flow comprising: a gas line from the liquified gas reservoir; a first gas pressure actuated three-way valve having a normally closed port connected to the gas line, a normally opened port connected to vent, and a common port connected to the gas pressure actuator of the flow valve; a second gas pressure actuated three-way valve having a common port connected to the gas pressure actuator of the first three-way valve, a normally opened port connected to the gas line, and a normally closed port connected to vent; a first restricting means adapted to provide a first time delay for switching the second three-way valve from normally opened to normally closed; and a second restricting means adapted to provide a second time delay for switching the second three-way valve from normally closed to normally opened. In another embodiment, the system provides a controller connected between the gas line and the normally opened port of the second three-way valve which is activated by a remote located temperature sensing device.

The system utilizes venting that must occur when a liquified gas is kept in an enclosed reservoir and maintained at a temperature below ambient. The liquified gas is at a low temperture and, however well insulated the reservoir may be, there is always some evaporation occurring from the liquid due to absorption of heat. The evaporation itself removes heat from the liquid and thus keeps the temperature of the remaining liquid below the evaporation point. The gas produced by evaporation must be vented, in some cases through a pressure-relief valve, to prevent a build-up of pressure beyond the designed pressure for the reservoir. By utilizing a portion of this gas and by means of restrictors to control the build-up and reduction of gas pressure, the timing of the switching of two gas pressure actuated three-way valves is arranged so that a flow valve for the liquified gas is switched on for a short period of time at predetermined time intervals.

In drawings which illustrate embodiments of the invention:

Figures 1, 2:
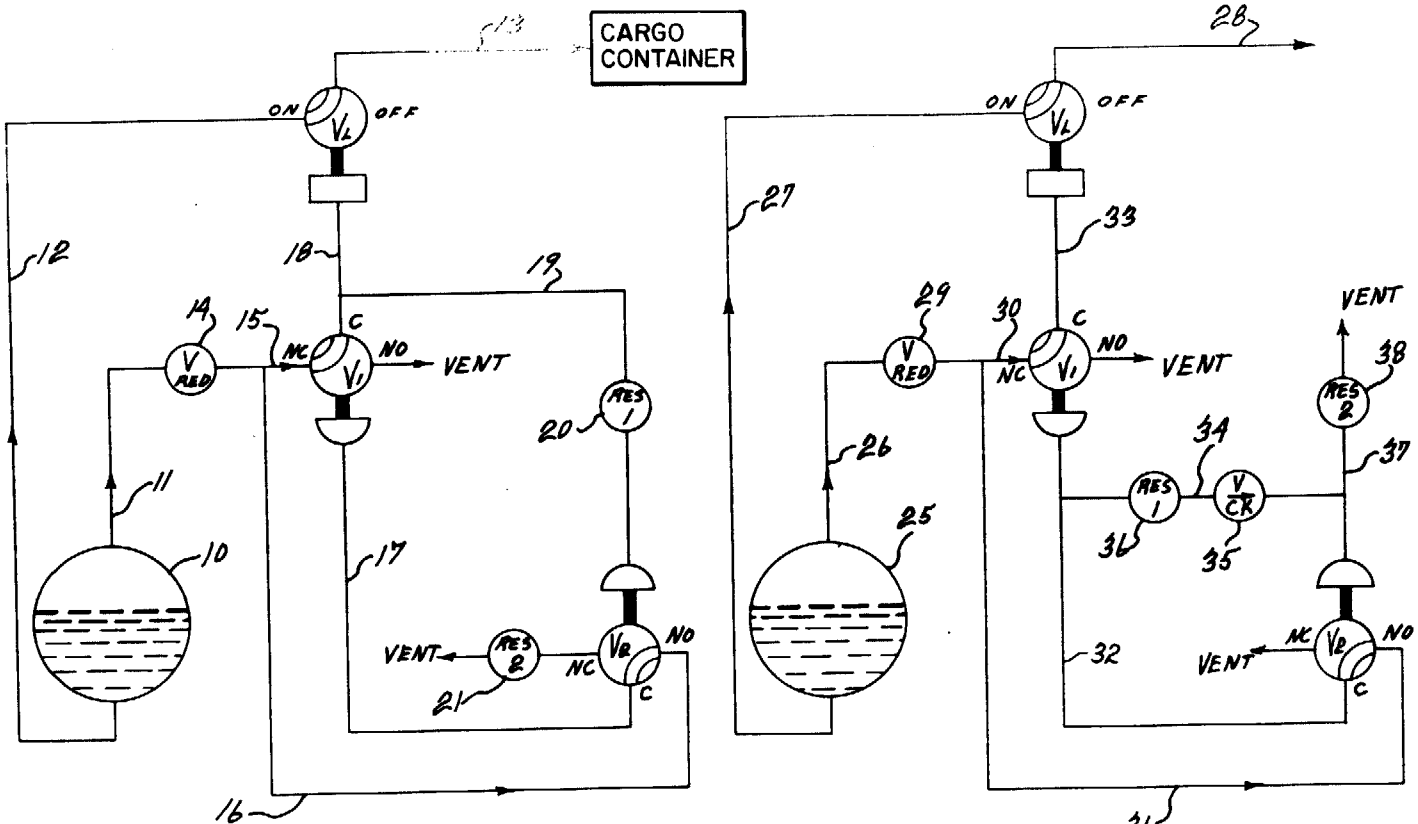
FIG. 1 is a schematic diagram of one embodiment of the present invention showing a control system for a refrigeration unit including a pressurized liquified gas reservoir and a gas pressure actuated flow valve for releasing the liquified gas.
FIG. 2 is a schematic diagram of another embodiment of the control system shown in FIG. 1.

Referring now to FIG. 1, a pressurized liquified gas reservoir 10 is shown having a gas line 11 and a liquid line 12. A normally closed gas pressure actuated liquid flow valve $V_L$ is shown in the liquid 12 switched to the ON position where it connects to an exit line 13. In the case of a cryogenic low pressure liquified gas such as nitrogen, the flow of liquid is controlled by the flow valve $V_L$. In the case of liquified carbon dioxide, an orifice is incorporated either with or downstream adjacent to the flow valve $V_L$ and liquid delivered to the exit line 13 experiences a pressure drop which changes its state to a solid and gaseous mix, entering the cooling chamber in that form.

A reducing valve 14 is positioned in the gas line 11 to reduce the pressure for the control media. In some cases, where the pressure in the reservoir 10 is low, a reducing valve is unnecessary. A first gas line 15 from the reducing valve 14 enters a first gas pressure actuated three-way valve $V_1$ through a normally closed port NC. A second gas line 16 from the reducing valve 14 enters a second gas pressure actuated three-way valve $V_2$ through a normally opened port NO. A common port C from the second three-way valve $V_2$ has a connecting line 17 to the gas pressure actuator of the first three-way valve $V_1$. A common port C from the first three-way valve $V_1$ has a connecting line 18 to the gas pressure actuator of the flow valve $V_L$. A normally opened port NO of the first three-way valve $V_1$ is connected to vent. The gas pressure actuator of the second three-way valve $V_2$ has a connecting line 19 having a first restrictor 20 therein, joined to the line 18. The normally closed port NC of the second three-way valve $V_2$ is connected to vent through a second restrictor 21. The first restrictor 20 and second restrictor 21 are both variable restrictors so the time delays may be varied as required.

In operation gas pressure builds up in the reducing valve 14, along the second gas line 16, through the NO port of the second three-way valve $V_2$ and along the connecting line 17 to the gas pressure actuator of the first three-way valve $V_1$. The valve $V_1$ switches and the NC port is connected to the C port. Thus, gas pressure builds up in the first gas line 15, along the connecting line 18 to the gas pressure actuator of the flow valve $V_L$ and switches the flow valve to the ON position so that liquid passes from the liquid line 12 to the exit line 13. At the same time, gas pressure builds up in the connecting line 19 to the first restrictor 20. The restrictor 20 causes a time delay as the gas pressure slowly builds up, until after a preset time the gas pressure actuator causes the valve $V_2$ to switch and the NC port is connected to the C port. As soon as this happens, the gas pressure in connecting line 17 and in the actuator of valve $V_1$ reduces as the gas exits through valve $V_2$, and the second restrictor 21 to vent. The adjustment of the second restrictor 21 governs the time taken for the gas pressure to drop. When the pressure has dropped a sufficient amount the valve $V_1$ switches, and the NO port is connected to the C port. The gas pressure in the actuator of the flow valve $V_L$ and connecting lines 18 and 19 drops as the gas exits to vent through valve $V_1$. The flow valve $V_L$ instantly closes. The gas pressure in the actuator of valve $V_2$ slowly drops as gas exits through the restrictor 20 to vent causing a still further time delay. When the pressure has dropped a sufficient amount, the valve $V_2$ switches, the NO port is connected to the C port, and the sequence commences again.

The control system of FIG. 2 has some slight differences from the embodiment illustrated in FIG. 1. The reservoir 25 has a gas line 26 and a liquid line 27. A normally closed gas pressure actuated liquid flow valve $V_L$ is shown in the liquid line 27 switched to the ON position where it connects to an exit line 28. A reducing valve 29 is positioned in the gas line 26 and has a first gas line 30 leading therefrom which enters the NC port of a first gas pressure actuated three-way valve $V_1$ and a second gas line 31 which enters the NO port of a second gas pressure actuated three-way valve $V_2$. A connecting line 32 extends from the C port of valve $V_2$ to the actuator of valve $V_1$ and the NC port of valve $V_2$ passes to vent. A further connecting line 33 extends from the C port of valve $V_1$ to the actuator of the flow valve $V_L$. The NO port of valve $V_1$ passes to vent. A connecting line 34 from the actuator of the valve $V_2$ passes through a non-return or check valve 35 and a first restrictor 36 to joint connecting line 32. A second connecting line 37 from the actuator of valve $V_2$ passes to vent through a second restrictor 38. The check valve 35 permits the flow of gas from the connecting line 32 to the actuator of valve $V_2$, but not in the reverse direction. The second restrictor 38 has a smaller flow than the first restrictor 36. The restrictors may be fixed or variable, but in the preferred embodiment are variable so the time delays may be varied.

In operation gas pressure builds up in the reducing valve 29 along the second gas line 31, through valve $V_2$ and along connecting line 32 to the actuator of valve $V_1$. The valve $V_1$ switches and the NC port is connected to the C port. Thus, gas pressure builds up in the first gas line 30 along connecting line 33 to the actuator of the flow valve $V_L$. The flow valve $V_L$ switches to the ON position so that liquid passes from the liquid line 27 to the exit line 28. At the same time gas pressure builds up in the connecting line 32 along connecting line 34 through the restrictor 36 and the check valve 35 to the actuator of valve $V_2$. A certain amount of gas escapes to vent along the second connecting line 37 and the second restrictor 38. However, the second restrictor 38 has a small flow than the first restrictor 36, so after a time delay the valve $V_2$ switches and the NC port is connected to the C port. This immediately allows the connecting line 32 to vent through valve $V_2$ which, in turn, switches valve $V_1$ so the NO port is connected to the C port. This, in turn, permits connecting line 33 to vent which switches the flow valve $V_L$ to the OFF position. Gas pressure slowly drops as gas vents along line 37 through restrictor 38, but cannot pass along connecting line 34 because of check valve 35. After a predetermined time delay valve $V_2$ switches, and the NO port is again connected to the C port. Thus the size of the restrictors 36 and 38 control the time delays for switching of valve $V_2$. The cycle then recommences and continues until the supply of gas in the gas line 26 is turned off or finished.

Figure 3:
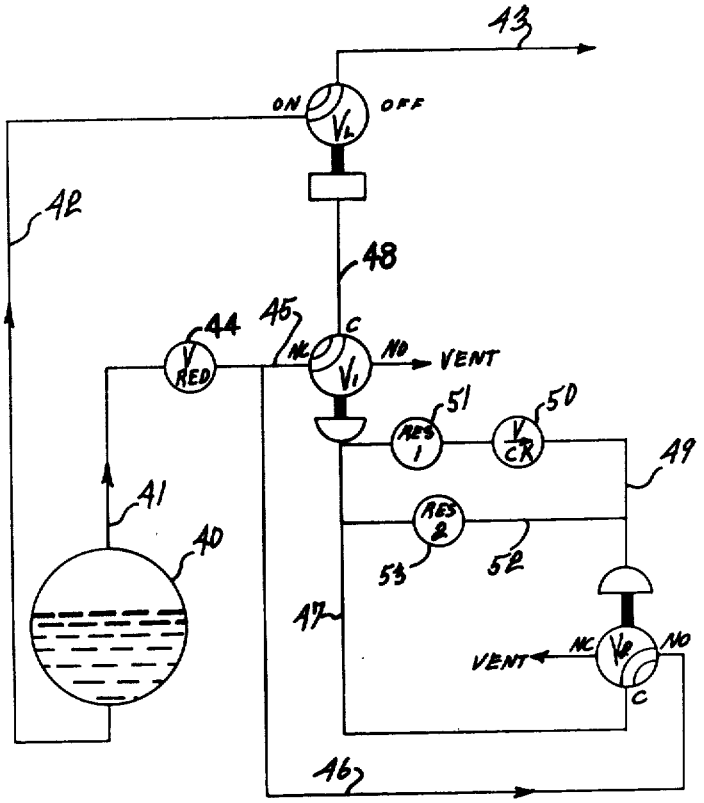
FIG. 3 is a schematic diagram of a further embodiment of the control system shown in FIG. 1.

Yet another embodiment is shown in FIG. 3, in which a reservoir 40 has a gas line 41 and a liquid line 42. A normally closed gas pressure actuated liquid flow valve $V_L$ is shown in the liquid line 42 switched to the ON position where it connects to an exit line 43. A reducing valve 44 is positioned in the gas line 41 and has a first gas line 45 leading therefrom which enters the NC port of a first gas pressure actuated three-way valve $V_1$ and a second gas line 46 which enters the NO port of a second gas pressure actuated three-way valve $V_2$. A connecting line 47 extends from the C port of valve $V_2$ to the actuator of valve $V_1$ and the NC port of valve $V_2$ passes to vent. A further connecting line 48 extends from the C port of $V_1$ to the actuator of the flow valve $V_L$. The NO port of valve $V_1$ passes to vent. A connecting line 49 from the actuator of valve $V_2$ passes through a check valve 50 and a first restrictor 51 to join the connecting line 47. A second connecting line 52 passes from the actuator of valve $V_2$ through a second restrictor 53 to join the connecting line 47.

In operation gas pressure builds up in the second gas line 46 through valve $V_2$ and along connecting line 47 to the actuator of valve $V_1$. The valve $V_1$ switches and the NC port is connected to the C port. Thus gas pressure in the first gas line 45 connects via line 48 to build up in the actuator of the flow valve $V_L$, and switches the flow valve $V_L$ to the ON position so that liquid passes from the liquid line 42 to the exit line 43. At the same time, gas pressure builds up in the connecting line 47 along connecting line 49 through the restrictor 51 and the check valve 50 to the connecting line 52, through the restrictor 53 to the actuator of valve $V_2$. After a predetermined time delay for the pressure to build up in the actuator of valve $V_2$, valve $V_2$ switches and the NC port is connected to the C port. This immediately allows the gas pressure in the connecting line 47 to drop as the gas vents through valve $V_2$, which, in turn, switches valve $V_1$ so the NO port is connected to the C port. This, in turn, permits the gas pressure in connecting line 48 to drop as the gas vents and the flow valve $V_L$ switches to the OFF position. Gas slowly escapes from the actuator of valve $V_2$ along connecting line 52, through the restrictor 53 to the connecting line 47 and hence through valve $V_2$ to vent. The check valve 50 prevents the gas escaping along connecting line 49. After a preset time, depending on the size of the restrictor 53, the actuator of valve $V_2$ switches and the NO port is again connected to the C port recommence the cycle.

In another embodiment of a control system similar to that shown in FIG. 3, the connecting line 49 containing the first restrictor 51 and the check valve 50 may be omitted. In such a system the ratio of time flow valve ON to time flow valve OFF is fixed and of approximately equal duration. However, the second restrictor 53 may be a variable restrictor; therefore, the time delays may be varied but not the ratio of time ON to time OFF.

The preferred type of restrictor is the needle type which has a tapered needle inserted into an orifice. The flow is adjustable by varying the position of the needle in the orifice. When the needle is inserted all the way into the orifice, the greatest restriction occurs. Movement of the needle allows adjustments in flow to be made and hence adjustments in time delays.

Figure 4:
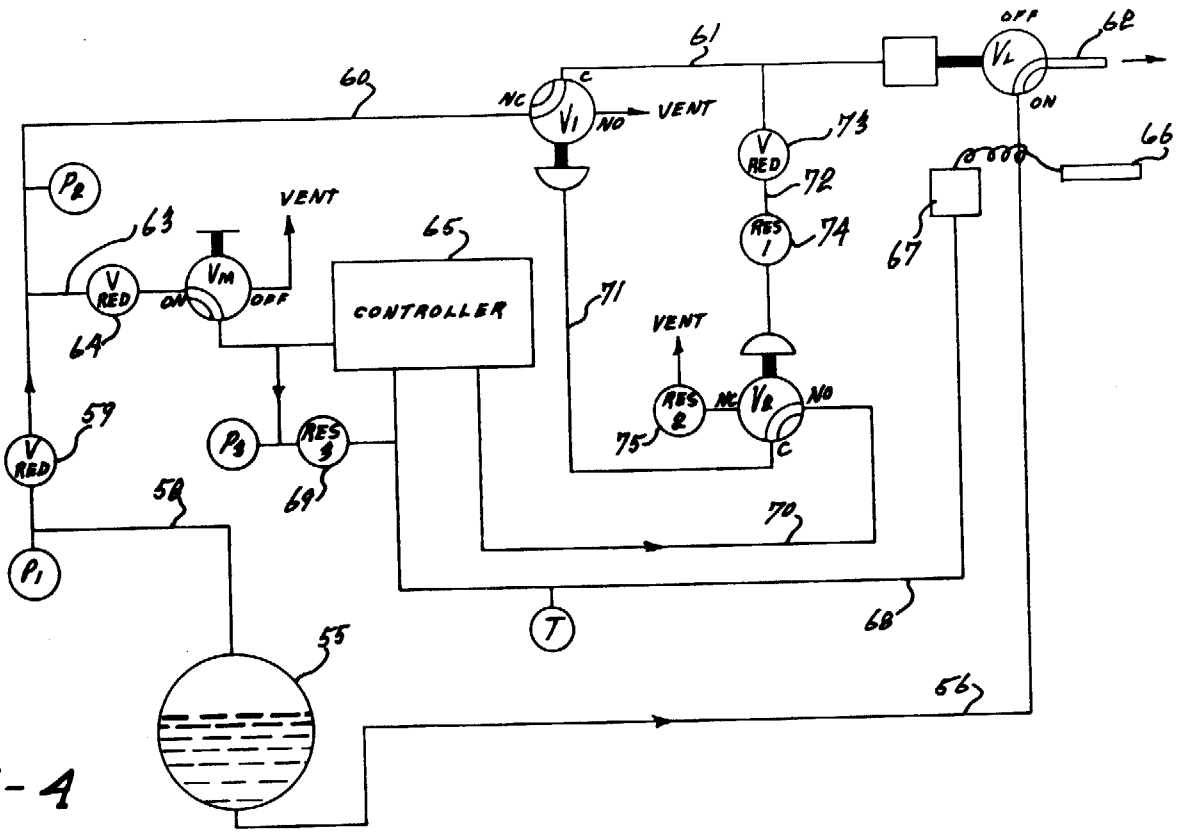
FIG. 4 is a schematic diagram of one embodiment of the present invention showing a control system for a refrigeration unit including a pressurized liquified gas reservoir, a gas pressure actuated flow valve for releasing the liquified gas and a temperature sensing device.

A complete control system incorporating a switch and temperature sensing device is shown in FIG. 4 wherein a liquid carbon dioxide reservoir 55 is shown having a liquid line 56 extending from the bottom of the reservoir 55 to a gas pressure piston actuated ON/OFF liquid flow valve $V_L$. A gas line 58 passes from the top of the reservoir 55 through a pressure reducing valve 59, which reduces the pressure from 300 lbs. per square inch to 60 lbs. per square inch, to a line 60 which passes to the NC port of a first diaphragm operated three-way valve $V_1$. A connecting line 61 from the C port of valve $V_1$ passes to the piston actuator of the liquid flow valve $V_L$. The liquid valve $V_L$ controls the flow of liquid from the liquid line 56 to the exit orifice 62. In co-pending application Serial No. 235,730, the exit orifice is described as a snow horn. Pressure gauges $P_1$ and $P_2$ indicate pressures in the reservoir 55 and the line 60 respectively.

In a separate line 63 from the low pressure side of the reducing valve 59 in line 60, another reduction valve 64 reduces the gas pressure from 60 lbs. per square inch to 20 lbs. per square inch, which is the control system pressure, through a manual ON/OFF three-way valve $V_M$ which manually operates the control system. When the valve $V_M$ is in the OFF position, gas pressure build-up in the reservoir is prevented by a pressure regulating valve or the like which is not shown but is included in the majority of refrigerated liquified gas reservoirs. When the valve $V_M$ is in the ON position, gas pressure is provided to the controller 65. A temperature sensing device 66 located within the cooling chamber feeds a signal to a temperature transmitter 67 which unit then correspondingly varies pressure in the temperature transmission line 68. This system works by varying the escape of gas through the temperature transmitter 67, thus varying the pressure in the temperature transmission line 68 which is itself fed a constant flow of gas through a restrictor 69 from a branch of line 63. The control system pressure in the line before the restrictor 69 is indicated by a pressure gauge $P_3$. The moduated signal from the temperature transmission line 68 is fed to the controller 65. A pressure gauge T in line 68, downstream of the restrictor 69, is calibrated to read in degrees and thus gives a visual indication of the temperature in the container. The controller has a manual adjustable setting which is set to suit the temperature requirements within the container. When the pressure in the temperature transmission line 68 rises above a certain level which is representative of the selected temperature, the controller 65 opens a gas line 70 which allows a build-up of gas pressure in the NO port of a second diaphragm operated three-way valve $V_2$. This is connected to the C port, and through connecting line 71 to the diaphragm of a first diaphragm operated three-way valve $V_1$. Valve $V_1$ switches allowing gas pressure in line 60 to connect via valve $V_1$ through the NC port and C port, and to build up in the connecting line 61 which joins the piston actuator of the liquid valve $V_L$. The valve $V_L$ switches to the ON position, allowing liquid to flow to the exit orifice 62. At the same time gas pressure builds up in the connecting line 61, the gas line 72, and the diaphragm of valve $V_2$, passing through a pressure reducing valve 73 where the pressure is reduced from 60 lbs. per square inch to 20 lbs. per square inch and a first restrictor 74. This first restrictor 74 delays the pressure build-up on the diaphragm of valve $V_2$. However, when sufficient pressure is reached, valve $V_2$ switches which allows the gas pressure in the diaphragm of valve $V_1$ and line 71 to drop slowly through the C port and NC port of valve $V_2$ and a second restrictor 75 to vent. Thus, although the controller 65 remains open and continues to pass its own demand signal in the form of gas pressure, the signal is interrupted by the switching of valve $V_2$. After a time delay when sufficient gas pressure has dropped by venting through the restrictor 75, valve $V_1$ switches, thus venting line 61 through the C port and NO port of valve $V_1$. The liquid valve $V_L$ switches to the OFF position thus closing the liquid flow and the gas entrapped in gas line 72 and the diaphragm of valve $V_2$ escapes slowly through the restrictor 74, line 61, the C port and NO port of valve $V_1$ to vent, until valve $V_2$ switches and the cycle recommences. The period of cycle and the relative duration of the liquid flow times are set by the adjustments of the restrictors 74 and 75.

Figure 5:
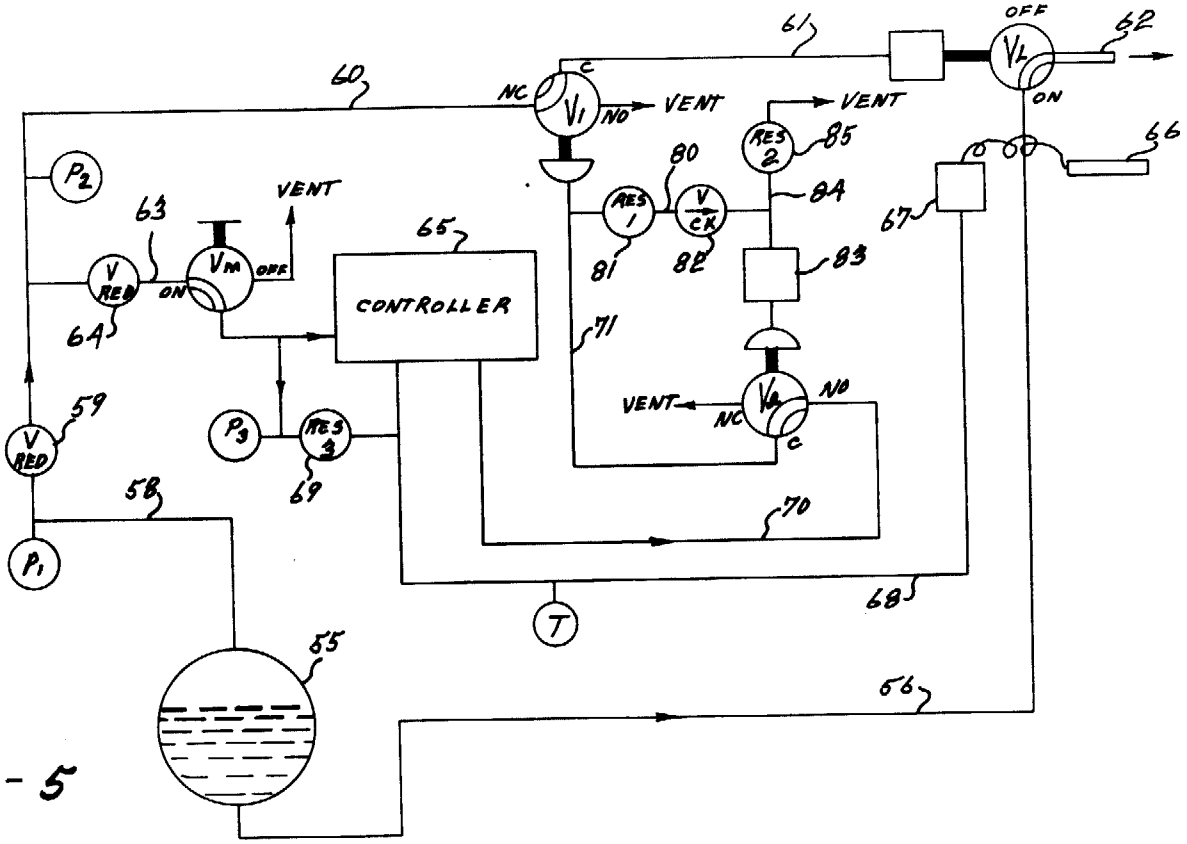
FIG. 5 is a schematic diagram of another embodiment of the control system shown in FIG. 4.

A further schematic diagram is shown in FIG. 5 wherein a different method is employed of controlling the opening and closing of liquid valve $V_L$. In this embodiment, a gas line 80 passes from the connecting line 71 through a first restrictor 81 and a check valve 82 to a capacity chamber 83 and finally to the diaphragm of valve $V_2$. A further gas line 84 passes from the capacity chamber 83 through a second restrictor 85 to vent. The second restrictor 85 has a lower flow capacity than the first restrictor 81 and the system operates in the manner described and illustrated in FIG. 2. The capacity chamber 83 may be incorporated in any of the various embodiments illustrated and is for the purpose of increasing the delay time to both build up and reduce the gas pressure on an actuator for a three-way valve, thus extending the time between the switching of the three-way valves.

In one example of the present invention, a 1/16 inch expansion nozzle was fitted as an exit orifice 62 to the liquid valve $V_L$ as illustrated in FIG. 4. This size of nozzle allowed approximately one pound of liquid carbon dioxide at 300 lbs. per square inch to pass into the interior of a standard container in 15 seconds. A control system of the type shown in FIG. 4 was arranged so the nozzle was opened for a total of 10 seconds in every minute as long as the controller issued a demand signal. The storage reservoir 55 carried 900 lbs. of liquid carbon dioxide and there was approximately 100° F temperature differential between the inside and the outside of the container. The container had a 40 B.T.U. nominal heat loss per hour per degree Fahrenheit difference. Carbon dioxide in the storage tank lasted for a duration of 36 hours before requiring replenishing.

In another example, it was determined that 30 lbs. per hour of liquid carbon dioxide was necessary to maintain as insulated container at a desired temperature in particular ambient conditions. However, it was not desirable to have one injection of 30 lbs. every hour as this would be an overshoot resulting in a considerable variation in temperature from hour to hour. Thus it was decided to have 90 injections, one in each 40 seconds. Inasmuch as the size of nozzle allowed one pound of carbon dioxide liquid to be passed through in 15 seconds, it followed that the duration of each injection should be 5 seconds, thus giving one third lb. per injection. Consequently, the duration of injection was 5 seconds and the time between injections was 40 seconds. The variable restrictors on the control system were adjusted accordingly.

The embodiments of the invention in which an exclusive property or privilege is claimed are defined as follows:

1. In a refrigeration unit including a pressurized liquified gas reservoir and a gas pressure actuated flow valve for releasing the liquified gas, the improvement of a control system for metering liquified gas flow comprising:

a gas line from the liquified gas reservoir;

a first gas pressure actuated three-way valve having a normally closed port connected to the gas line, a normally opened port connected to vent, and a common port connected to the gas pressure actuator of the flow valve;

a second gas pressure actuated three-way valve having a common port connected to the gas pressure actuator of the first three-way valve, a normally opened port connected to the gas line, and a normally closed port connected to vent;

a first restricting means adapted to provide a first time delay for switching the second three-way valve from normally opened to normally closed;

and a second restricting means adapted to provide a second time delay for switching the second three-way valve from normally closed to normally opened.

2. The control system according to claim 1 wherein the gas is carbon dioxide.

3. The control system according to any of claim 1 wherein the first restricting means includes a connection from the gas pressure actuator of the second three-way valve to the common port of the first three-way valve having a first restrictor therein, and a second restricting means includes the first restrictor and a second restrictor at the normally closed port of the second three-way valve connected to vent.

4. The control system according to any of claim 1 wherein the first restricting means includes a connection from the gas pressure actuator of the second three-way valve to the common port of the second three-way valve having a first restrictor and a non-return valve therein, the non-return valve permitting gas to the gas pressure actuator of the second three-way valve, and a second restricting means includes a second restrictor between the gas pressure actuator of the second three-way valve and a vent, the second restrictor having a smaller flow than the first restrictor.

5. The control system according to any of claim 1 wherein the first restricting means includes a first connection from the gas pressure actuator of the second three-way valve to the common port of the second three-way valve having a first restrictor and a non-return valve therein, the non-return valve permitting gas flow to the gas pressure actuator of the second three-way valve, and the second restricting means includes a second connection from the gas pressure actuator of the second three-way valve to the common port of the second three-way valve, having a second restrictor therein.

6. The control system according to any of claim 1 including gas capacity chamber positioned upstream of at least one of the first or second restricting means adapted to increase the time delay for switching the second three-way valve.

7. The control system according to any of claim 1 wherein the first restricting means includes a connection from the gas pressure actuator of the second three-way valve to the common port of the second three-way valve having a restrictor therein, and the second restricting means includes the said connection and said restrictor therein.

8. The control system according to any of claim 1 wherein the first and second restricting means have an adjustment means to vary the first and second time delays.

9. The control system according to claim 1 wherein the gas is nitrogen.

10. In a refrigeration unit including a pressurized liquified gas reservoir, a gas pressure actuated flow valve for releasing the liquified gas, and a temperature sensing device, the improvement of a control system for metering liquified gas flow comprising:

a gas line from the liquified gas reservoir;

a temperature sensing controller connected to the gas line adapted to open in response to a demand from the temperature sensing device;

a first gas pressure actuated three-way valve having a normally closed port connected to the gas line, a normally opened port connected to vent, and a common port connected to the gas pressure actuator of the flow valve;

a second gas pressure actuated three-way valve having a common port connected to the gas pressure actuator of the first three-way valve, a normally opened port connected to the temperature sensing controller, and a normally closed port connected to vent;

a first restricting means adapted to provide a first time delay for switching the second three-way valve from normally opened to normally closed;

and a second restricting means adapted to provide a second time delay for switching the second three-way valve from normally closed to normally opened.

11. The control system according to claim 3 wherein the gas pressure actuated flow valve is a piston actuated flow valve, and the first and second three-way valves are diaphragm-operated.

* * * * *